United States Patent [19]

Harruff

[11] 3,965,593

[45] June 29, 1976

[54] NUMERIC DISPLAY USING THREE ENDLESS BELTS

[75] Inventor: Robert J. Harruff, Pardeeville, Wis.

[73] Assignee: General Indicator Corporation, Pardeeville, Wis.

[22] Filed: Nov. 18, 1974

[21] Appl. No.: 524,746

[52] U.S. Cl. ..... 40/32; 40/96; 40/125 E

[51] Int. Cl.[2] ..... G09F 11/28

[58] Field of Search ..... 40/31, 32, 33, 53 R, 40/86 R, 96, 28 C, 125 E, 130 E, 77.4, 36 R; 340/336, 324 B, 379; 116/124.1

[56] References Cited

UNITED STATES PATENTS

| | | | |
|---|---|---|---|
| 2,118,696 | 5/1938 | Bonetti | 40/53 R |
| 2,145,946 | 2/1939 | Morrissey | 40/125 E |
| 2,167,518 | 7/1939 | Lins | 40/86 R |

FOREIGN PATENTS OR APPLICATIONS

| | | | |
|---|---|---|---|
| 458,428 | 7/1950 | Italy | 40/32 |

*Primary Examiner*—Louis G. Mancene
*Assistant Examiner*—John H. Wolff
*Attorney, Agent, or Firm*—Michael, Best & Friedrich

[57] ABSTRACT

Any numeric display (0–9) can be obtained by rotating the three endless belts to position the indicia on each to combine with the others to form the desired numeral. Each belt has a plurality of faces or display areas along its length and is driven by a separate motor until a sensing means determines the proper face is in display position. The belts follow a serpentine path to permit the belts to be housed in a frame about as high as the numeric readout. A change in the readout can be programmed and initiated at a remote location.

1 Claim, 6 Drawing Figures

Fig. 4
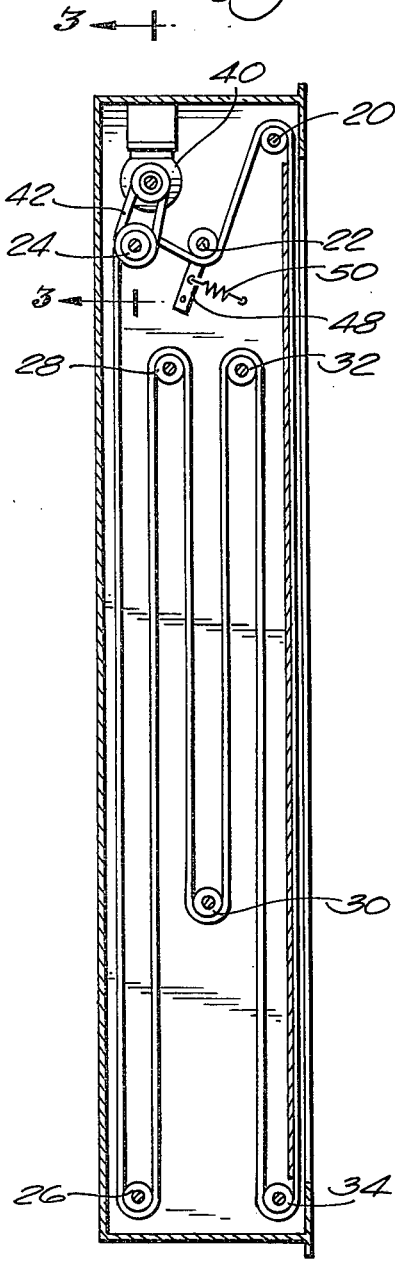
Fig. 5
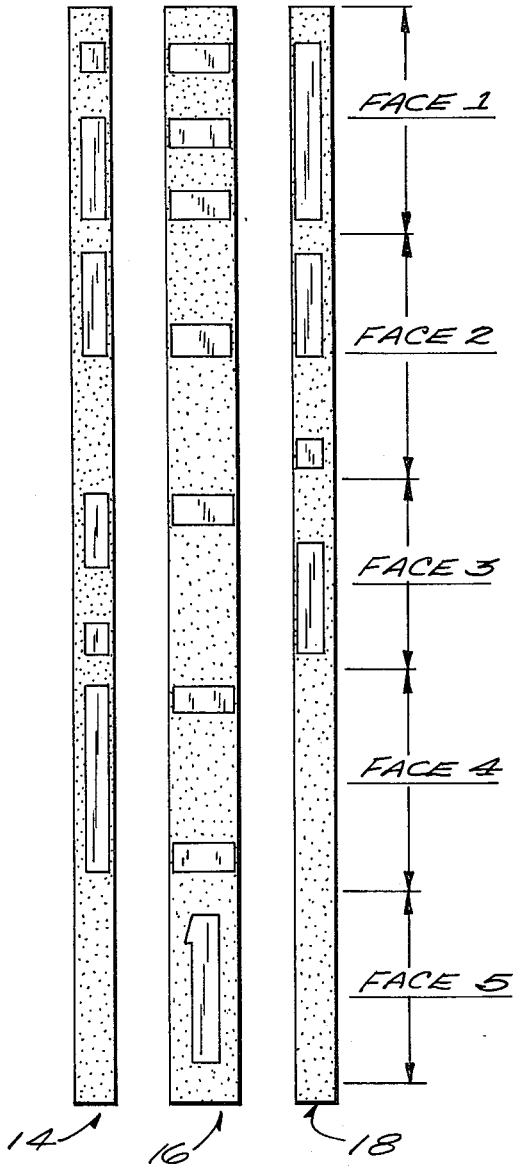
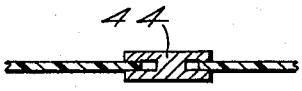
Fig. 6

NUMERIC DISPLAY USING THREE ENDLESS BELTS

BACKGROUND OF THE INVENTION

This invention relates to numeric display devices in which the display can be changed from a remote location. The type display contemplated here is relatively large. In the past tapes bearing all the numerals have been used but have had problems associated with the great length of the tape and with the width of the tape (too much unsupported area).

SUMMARY OF THE INVENTION

The object of this invention is to provide a compact tape-type sign which minimizes the tape length and minimizes the unsupported area of the tape on display. This is achieved by using three tapes each having a plurality of display areas bearing indicia which may combine with the indicia on the other tapes to form any desired numeral. During the change from one numeral to another the indicia are meaningless and an observer will not be misled by a quick glance.

DESCRIPTION OF THE DRAWINGS

FIG. 4 is a vertical section showing the belt and drive.

FIG. 5 is a "stretched" view of the three endless belts laid out flat to show the indicia.

FIG. 6 is a detail showing the belt guide between adjacent belts.

DESCRIPTION OF THE PREFERRED EMBODIMENT

Figure 1:
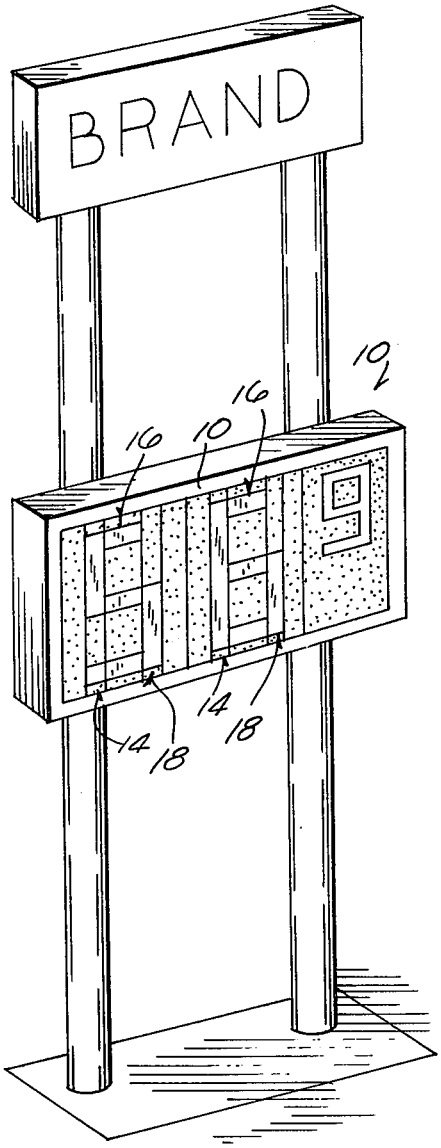
FIG. 1 is a perspective view of one type of sign in which this invention may be used to advantage.
Figure 2:
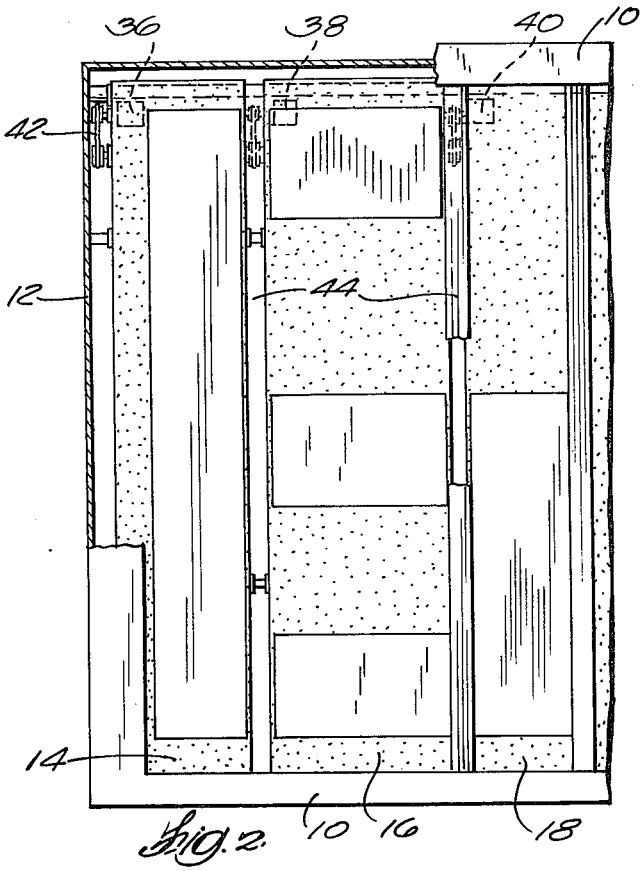
FIG. 2 is a front elevation of one unit showing the numeral 6 in the readout.

The sign shown in FIG. 1 is well suited to use adjacent highways since it stands 30 meters or more high and can be read at a great distance. In this instance the numeric display is the price of gasoline. The present design is also suitable for display of any numeric readout such as flight numbers, etc. Each digit is formed by proper positioning of the indicia on three tapes. The housing 10 encloses a number of frames 12 corresponding to the number of digits to be displayed. The front of each frame is open to display the tapes 14, 16, 18. Each tape is continuous and is reeved over a roller 20 at the top front, passes under a tensioning roller 22, over a drive roller 24, to idler rollers 26, 28, 30, 32 and then over roller 34 at the lower front to make the exposed pass in the front of the frame to roller 20. The drive roller 24 is driven by a motor 36, 38, 40 (as the case may be) through a belt 42.

Each motor is separately energized to drive the corresponding belt to its proper position to display the desired indicia on that belt which, when combined with the other displayed faces, will form the desired digit. The motors are energized from a remote location at which the desired digit is electrically selected whereupon the motors drive the belts until each belt reaches the proper position and the motor is de-energized. This type of positioning circuitry is not unique and may take various forms depending on the use of conductive strips on the inside of the tape or perforations in the tape with suitable conductive "feelers" sensing the proper position. The form of circuit employed is not important to this invention and a detailed disclosure thereof would only confuse the disclosure of this invention.

Each of the belts has five face areas bearing indicia as illustrated in FIG. 5. The following chart illustrates the manner in which the faces are combined to form numerals 0–9.

| Belt | Face | 0 | 1 | 2 | 3 | 4 | 5 | 6 | 7 | 8 | 9 |
|---|---|---|---|---|---|---|---|---|---|---|---|
| 14 | 1 | | | X | | | | | | | |
| | 2 | | | | | X | | | | | |
| | 3 | | | | | | X | | | | X |
| | 4 | X | | | | | | X | | X | |
| | 5 | | X | | X | | | | X | | |
| 16 | 1 | | | X | X | | X | X | | X | X |
| | 2 | | | | | X | | | | | |
| | 3 | | | | | | | | X | | |
| | 4 | X | | | | | | | | | |
| | 5 | | X | | | | | | | | |
| 18 | 1 | X | | | X | X | | | X | X | X |
| | 2 | | | X | | | | | | | |
| | 3 | | | | | | X | X | | | |
| | 4 | | | | | | | | | | |
| | 5 | | X | | | | | | | | |

Figure 3:
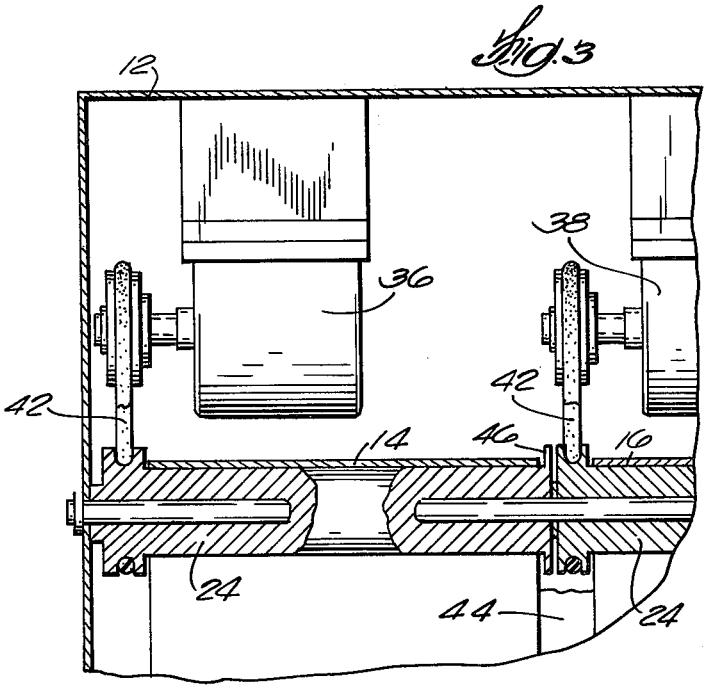
FIG. 3 is a detail section on line 3—3 of FIG. 4.

The tapes or belts are preferably made of a tough material such as Mylar having good dimensional stability. The edges are guided in channel shaped tracks 44 such as in FIG. 3. The exposed face of the track is kept narrow to minimize the gap between adjacent indicia. Rollers 20, 22, 26, 28, 30, 32, and 34 include flanges 46 at each end guiding the belt. Each tensioning roller 22 is carried on a pivoted arm 48 and is loaded by spring 50 to tension the associated belt. All the idler rollers (20, 26, 28, 30, 32, 34) are mounted on common shafts for independent movement . . . . i.e. all rollers 20 are on a single shaft. Each drive roller 24 is separately driven.

The maximum time to change numbers is the time to change four panels (or face portions). If one were to use a single belt with numerals 0–9, the maximum time to change numbers would be the time to move nine panels — 2.25 times as long. Further, the length of a 10-digit belt to be wound in the serpentine manner becomes difficult to house.

It will be noted that at least two belts must have at least one blank face in order to display numeral 1. Thus, as illustrated, belts 14 and 18 each have blanks at face 5 (also at face 4 in the case of belt 18). If numeral 1 is to be made out of face 1 on belt 18, then belt 16 would require a blank face (as would belt 14). The illustrated form with a centered numeral 1 and permitting the use of a serif is preferred for better legibility.

I claim:

1. A numeric display device comprising:

a housing having an open front, three endless belts mounted in the housing in side-by-side relationship with each belt reeved over rollers in serpentine fashion with a continuous face portion of each belt facing outwardly through the open front of the housing, each of the three belts having only five face portions, one of the belts having indicia on each of its five face portions while each of the other two belts has indicia on four face portions and a blank fifth face portion, the indicia on the three belts being combinable in the open front to form any desired numeral from 0–9, means driving each belt independently of the others so as to enable the various face portions to be positioned in the open front, and guide means in the open front between adjacent belts to guide the edges of each belt.

* * * * *